US007500617B2

(12) United States Patent
Wirtz et al.

(10) Patent No.: US 7,500,617 B2
(45) Date of Patent: Mar. 10, 2009

(54) SCREW DEVICE FOR HIGH-ADJUSTING A TRACK SPAN

(75) Inventors: Heinz-Peter Wirtz, Erkelenz (DE); Arnold Pieringer, Neumarkt (DE)

(73) Assignee: RAIL.ONE GmbH, Neumarkt (DE)

( * ) Notice: Subject to any disclaimer, the term of this patent is extended or adjusted under 35 U.S.C. 154(b) by 541 days.

(21) Appl. No.: 10/533,189

(22) PCT Filed: Nov. 15, 2003

(86) PCT No.: PCT/EP03/12782

§ 371 (c)(1),
(2), (4) Date: Sep. 1, 2005

(87) PCT Pub. No.: WO2004/065692

PCT Pub. Date: Aug. 5, 2004

(65) Prior Publication Data

US 2006/0011792 A1 Jan. 19, 2006

(30) Foreign Application Priority Data

Jan. 21, 2003 (DE) ..... 103 02 021
Apr. 9, 2003 (DE) ..... 103 16 143

(51) Int. Cl.
*E01B 9/00* (2006.01)

(52) U.S. Cl. ..... 238/2; 238/3; 238/7; 238/8; 238/9; 238/281; 238/282; 238/310

(58) Field of Classification Search ..... 238/120, 238/264, 265, 278, 281, 331, 332, 310, 1, 238/2, 3, 5, 6, 7, 8, 9, 282

See application file for complete search history.

(56) References Cited

U.S. PATENT DOCUMENTS

| | | | | | |
|---|---|---|---|---|---|
| 948,496 | A | * | 2/1910 | Bricker | 238/53 |
| 1,370,537 | A | * | 3/1921 | Heumann | 238/10 R |
| 2,664,113 | A | * | 12/1953 | Dodge | 139/100 |
| 3,066,869 | A | * | 12/1962 | Bishop | 238/9 |
| 4,783,001 | A | * | 11/1988 | Subrick | 238/53 |
| 5,150,835 | A | * | 9/1992 | Yamamoto | 238/50 |
| 5,285,964 | A | * | 2/1994 | Vanotti | 238/7 |
| 5,653,388 | A | * | 8/1997 | Pietschmann et al. | 238/7 |
| 6,237,856 | B1 | * | 5/2001 | Bachmann et al. | 238/7 |

FOREIGN PATENT DOCUMENTS

| | | |
|---|---|---|
| DE | 197 39 671 | 3/1999 |
| DE | 100 10 779 | 10/2001 |
| DE | 101 07 116 | 10/2002 |

* cited by examiner

*Primary Examiner*—Mark T Le
(74) *Attorney, Agent, or Firm*—Jordan and Hamburg LLP

(57) ABSTRACT

Spindle device for the height adjustment and alignment of tracks on a substructure, having a transverse cantilever which is fixed to an elongate nut adjustable in height on a height adjustment spindle and which engages under the rail and which is formed as a horizontal spindle plate which is mounted on the elongate nut pivotably about a horizontal axis and on which a slide provided with a clamping mount device for the rail foot is displaceable by means of a second spindle device transverse to the height adjustment spindle.

11 Claims, 6 Drawing Sheets

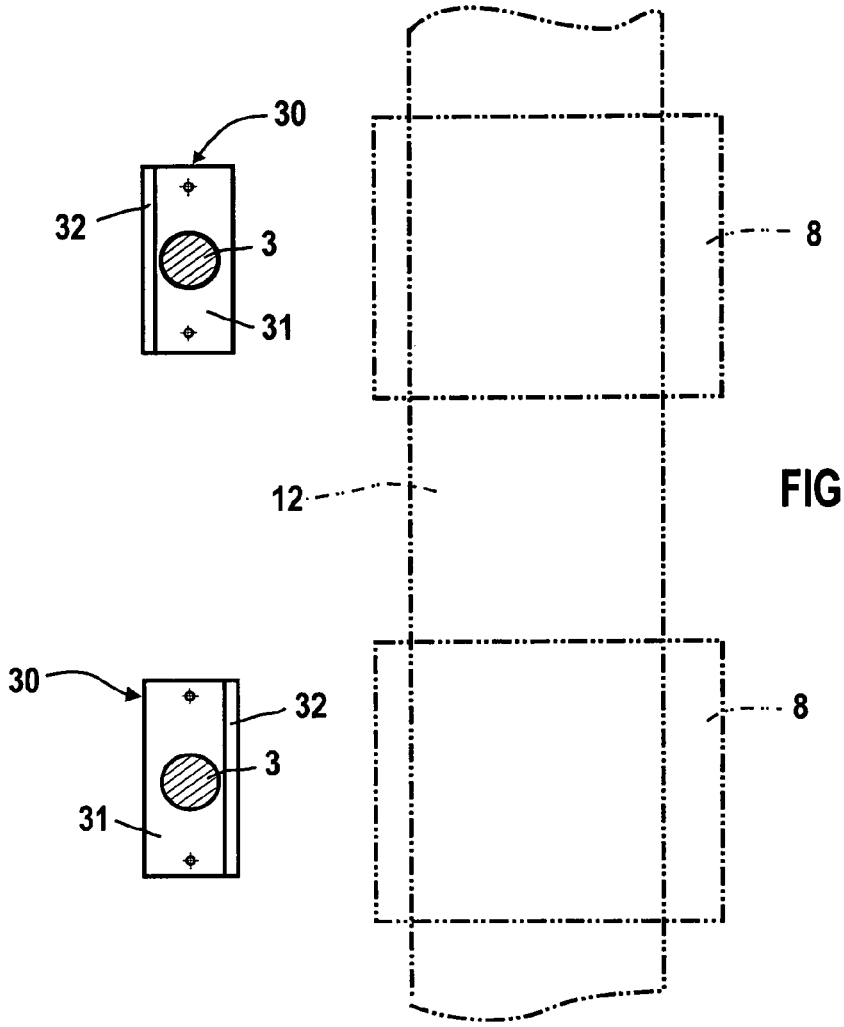
FIG. 9
FIG. 10
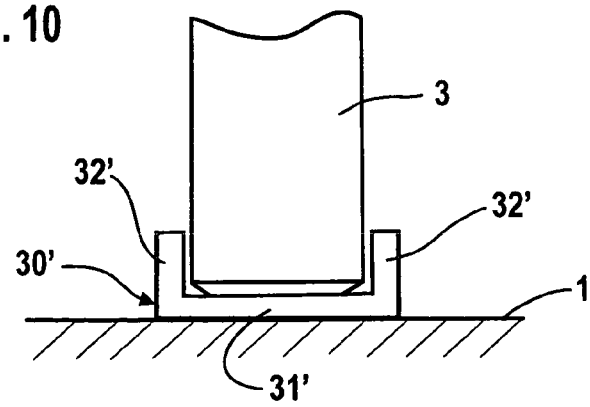

SCREW DEVICE FOR HIGH-ADJUSTING A TRACK SPAN

BACKGROUND OF THE INVENTION

The invention relates to a spindle device for adjusting the height of and aligning tracks on a substructure, having a transverse cantilever which is fixed to an elongate nut adjustable in height on a height adjustment spindle and which engages under the rails.

In the height adjustment and alignment of track grids for solid carriageways, it is not only necessary to adjust the rails to the correct height, but also to be able to bank these to some extent on bends, to which end the track grid needs to be tiltable. In a device disclosed in DE 197 671 C2 for the height adjustment and temporary support of rails, it is therefore provided that the rails bear on a bearing edge, so that when the track grid is more raised on one side than the other, as occurs at bends, the rails can tilt accordingly on their support. In this case, however, there is a risk that the vehicle may slip off sideways, and especially the height adjustment device provided in this case, with opposing displaceable wedges, is not suitable to effect the necessary horizontal displacement also required in aligning the track grids, since any horizontal displacement of one of the support wedges with the track would at the same time involve a change in the vertical position.

Spindle devices have proved advantageous in the height adjustment of track grids, although hitherto in principle two fully independent spindles have been required for height adjustment and horizontal displacement, the horizontal adjustment spindles involving the risk, in the case of large adjustments, of tilting of the vertical spindle, and hence the risk of inversion of the track.

SUMMARY OF THE INVENTION

The object of the invention is therefore so to form a spindle device for height adjustment and alignment of rails, in particular of track grids for solid carriageways, that a simpler and more reliable displacement is possible both in the vertical and in the horizontal directions without any adverse mutual interference.

To achieve this, it is proposed according to the invention that the transverse cantilever is formed as a horizontal spindle plate which is mounted pivotably about a horizontal axis on the elongate nut, and on which a slide provided with a clamping holding device for the rail foot is mounted displaceably by means of a second spindle device transverse to the height adjustment spindle.

With the configuration according to the invention, the transverse adjustment spindle no longer acts on the height adjustment spindle, so that unlike hitherto the height adjustment spindle is not pivoted out of its vertical position when a subsequent horizontal adjustment of the rail grid occurs. At the same time, the horizontal spindle plate mounted pivotably on the elongate nut provides a support for the rail, which can be adjusted to any desired angle where banked at a bend.

In an embodiment of the invention, it can be arranged that the slide consists of a ribbed plate provided with guide rails encompassing the horizontal spindle plate with a clamping hook and a conventional rail foot screw clamp. Thereby, a very simple mount of the rail is provided, which at the same time also permits a very simple horizontal adjustment device.

Thus according to a further feature of the invention, it can be provided that a rigid horizontal spindle penetrating a rest is fixed to the slide, in particular is welded thereto, and is displaceable along its longitudinal axis by means of adjusting nuts bearing on either side of the rest.

Furthermore, it is within the scope of the invention that the horizontal pivot joint of the horizontal spindle plate is fixable, which has the great advantage that during shaking or other forces acting laterally on a track grid, the support device cannot tip over.

In order to permit a simpler construction of the spindle device according to the invention after the casting of concrete, in an improvement of the invention it can be provided that the clamping hook can be removed above the ribbed plate, in particular in such a manner that the clamping hook is formed by a screw for a clamping plate overlapping the rail foot. This capacity of the clamping hook to be removed, in combination with a detachable fixing of the second spindle device both on the slide and on the horizontal spindle plate, permits simple removal of the support device, whilst a rigid hook makes it necessary at first to lower by the amount of projection of this hook.

If the second spindle device is so formed that it does not project above the sole of the rail foot, it may not need to be detachable, since this is provided purely in order that the support device according to the invention can be removed under the rail foot when this has been concreted in.

The length of the elongate nut mentioned, which is guided on the height adjustment spindle, is so selected that sufficient rigidity of the support is afforded, to which end it is advantageous if the elongate nut substantially overlaps the height adjustment spindle and only admits sufficient play for the usually necessary adjustment distances.

According to a further feature of the invention, support rails for the height adjustment spindles may be provided, which are fixed so as to rest on the track substructure and permit easier sliding in the longitudinal direction of the lower ends of the height adjustment spindles, so that differences due to thermal expansion can be compensated in the case of longer support periods.

In this case, it has been found particularly advantageous if the support rails are angled rails oriented opposite to one another with projecting bearing flanges for the height adjustment spindles, which prevents slipping off in the transverse direction. Here, oriented opposite to one another means that the angled rails face either both with their apertures outwards or both with their apertures inwards. U-shaped rails could also be used. The bearing flanges then abut in one case the height adjustment spindles on the inner face and/or on the outer face.

Further advantages, features and details of the invention will appear from the following description of an embodiment and from the accompanying drawings.

BRIEF DESCRIPTION OF THE DRAWINGS

FIG. 9 is a cross-sectional plan view along the line IX-IX in FIG. 5 with the slides and the rail foot of the rail being depicted by phantom lines; and FIG. 10 is a detail elevation showing the height adjustment spindle supported on a U-shaped support rail.

DESCRIPTION OF THE PREFERRED EMBODIMENTS

Figure 1:
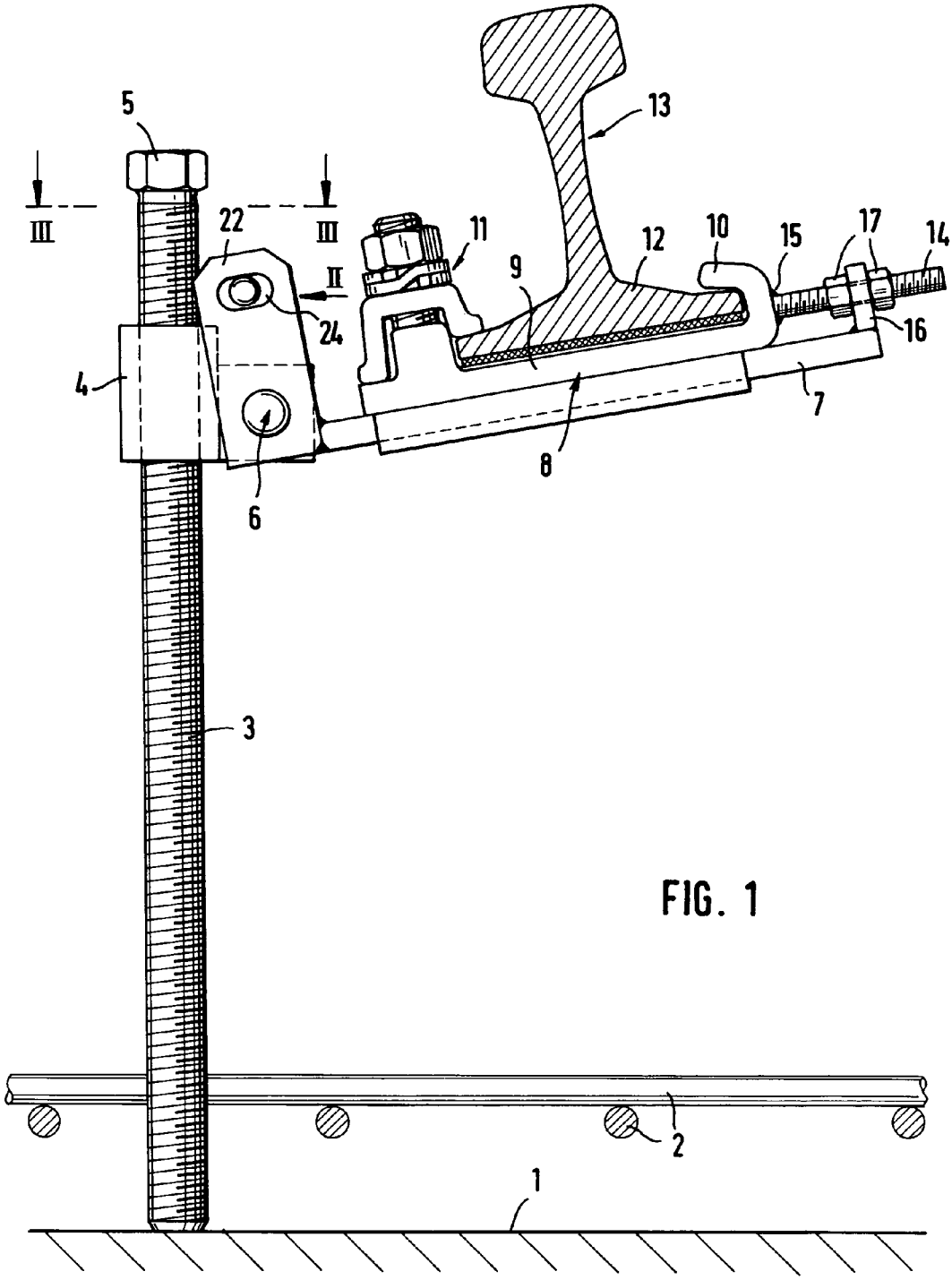
FIG. 1 a view of a spindle device according to the invention with a rail supported thereon of a track grid (not otherwise shown) in a tilted position, as occurs in track bends with a banked portion, FIG. 2 an enlarged detail of the pivot joint for the horizontal spindle plate in the direction of the arrow 11 in FIG. 1, FIG. 3 a section along the line III-III in FIG. 1, FIG. 4 a cross-section through the horizontal spindle plate, FIG. 5 a view corresponding to FIG. 1 of a modified spindle device with removable hook for the rail foot and a modified configuration of the pivot joint, FIG. 6 a plan view of the arrangement according to FIG. 5 without rail, FIG. 7 a view of FIG. 5 in the direction of the arrow VII in FIG. 5
Figure 2:
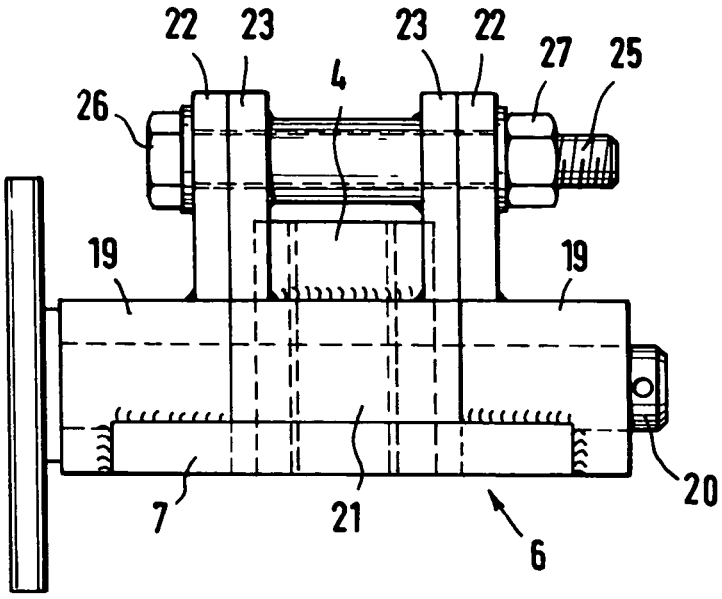
Figure 3:
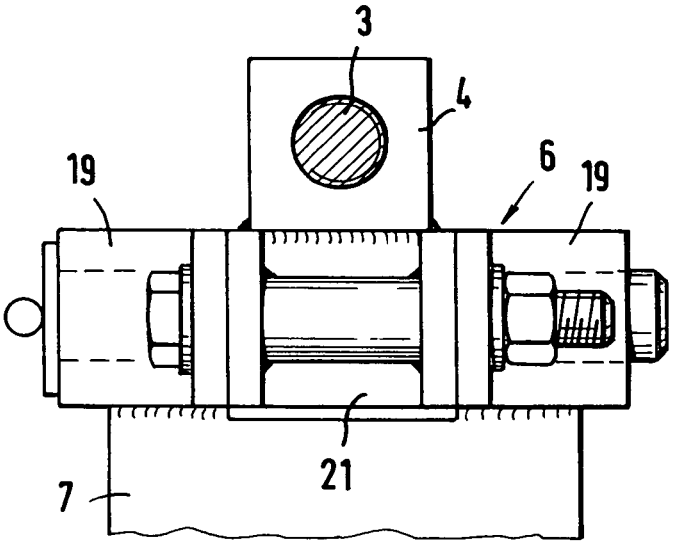

In FIG. 1, at 1, the upper face of a track substructure can be seen, over which reinforcement rods 2 are to be seen, which will be embedded during subsequent casting. On the substructure 1 is supported a height adjustment spindle 3, on which an elongate nut 4 is guided. By rotating the spindle e.g. by means of its hexagonal head 5, the height of the elongate nut can be adjusted, a horizontal spindle plate 7 being fixed to the nut via a hinge device 6. On this horizontal spindle plate, a slide 8 is mounted so as to be displaceable transversely, the slide comprising a ribbed plate 9 with a clamping hook 10 and a conventional rail foot screw clamp 11 for fixing the rail foot 12 of a rail 13. The rail 13 is in this case a rail of a track grid with sleepers (not shown) connecting the rails. Spindle devices according to the invention are disposed at intervals along both rails. For horizontal adjustment of the track grid, a horizontal spindle 14 is used, which is fixed to the ribbed plate, is welded thereto in the example shown at 15, and which penetrates a rest 16 of the horizontal spindle plate. By means of adjusting nuts 17 on the horizontal spindle 13, adjustment in the longitudinal direction of the horizontal spindle is possible, i.e. in the desired horizontal transverse adjustment direction of the track grid, without this transverse adjustment having any effect on the position of the height adjustment spindle.

Figure 4:
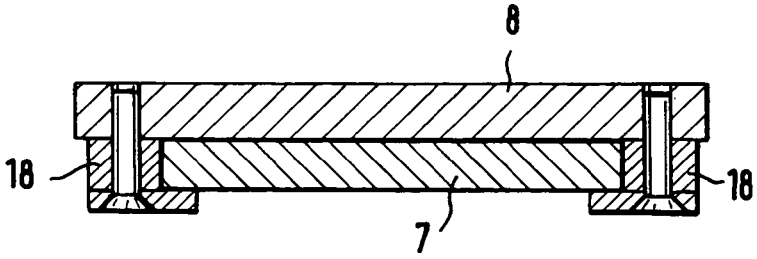
Figure 5:
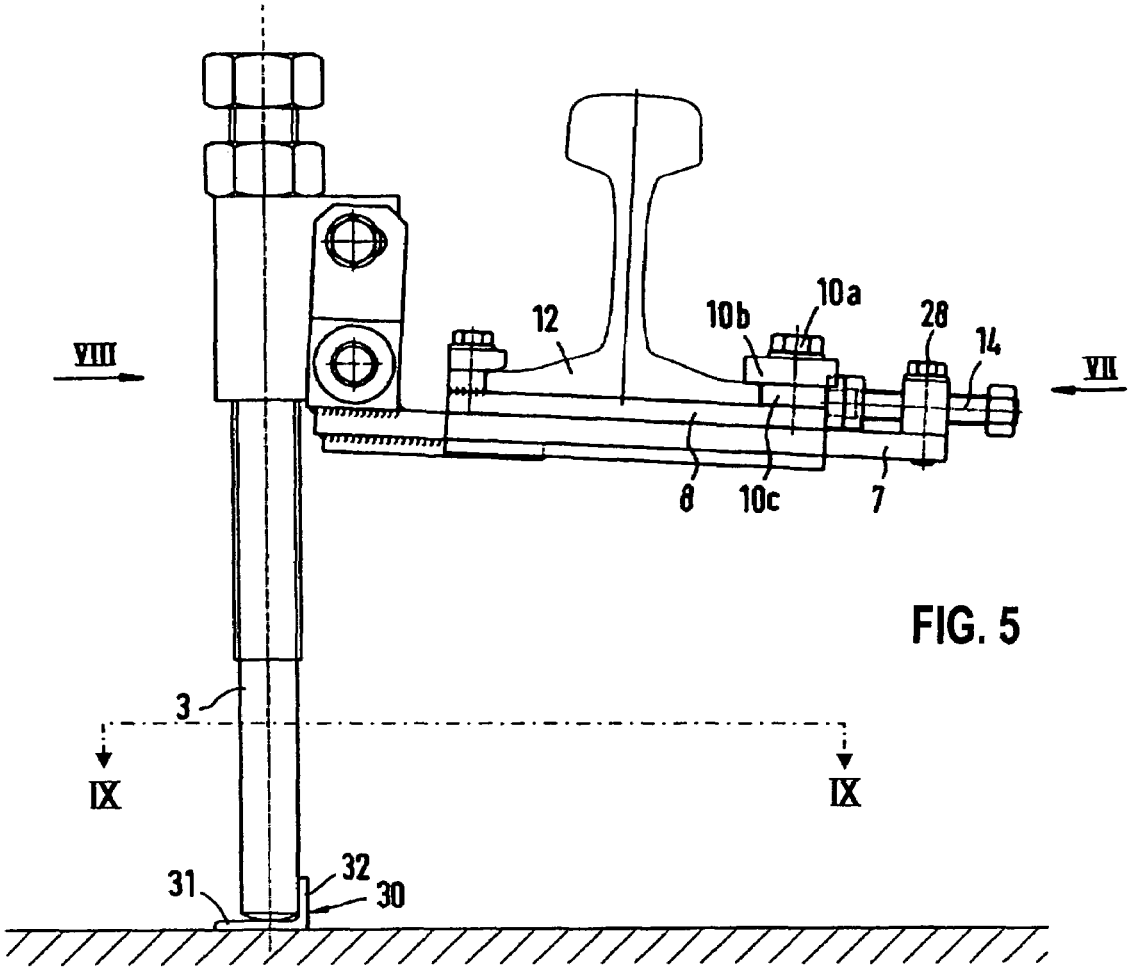
Figure 6:
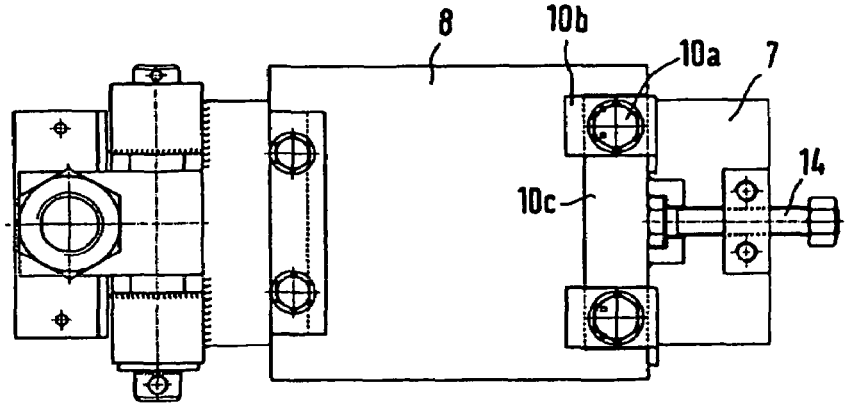
Figure 7:
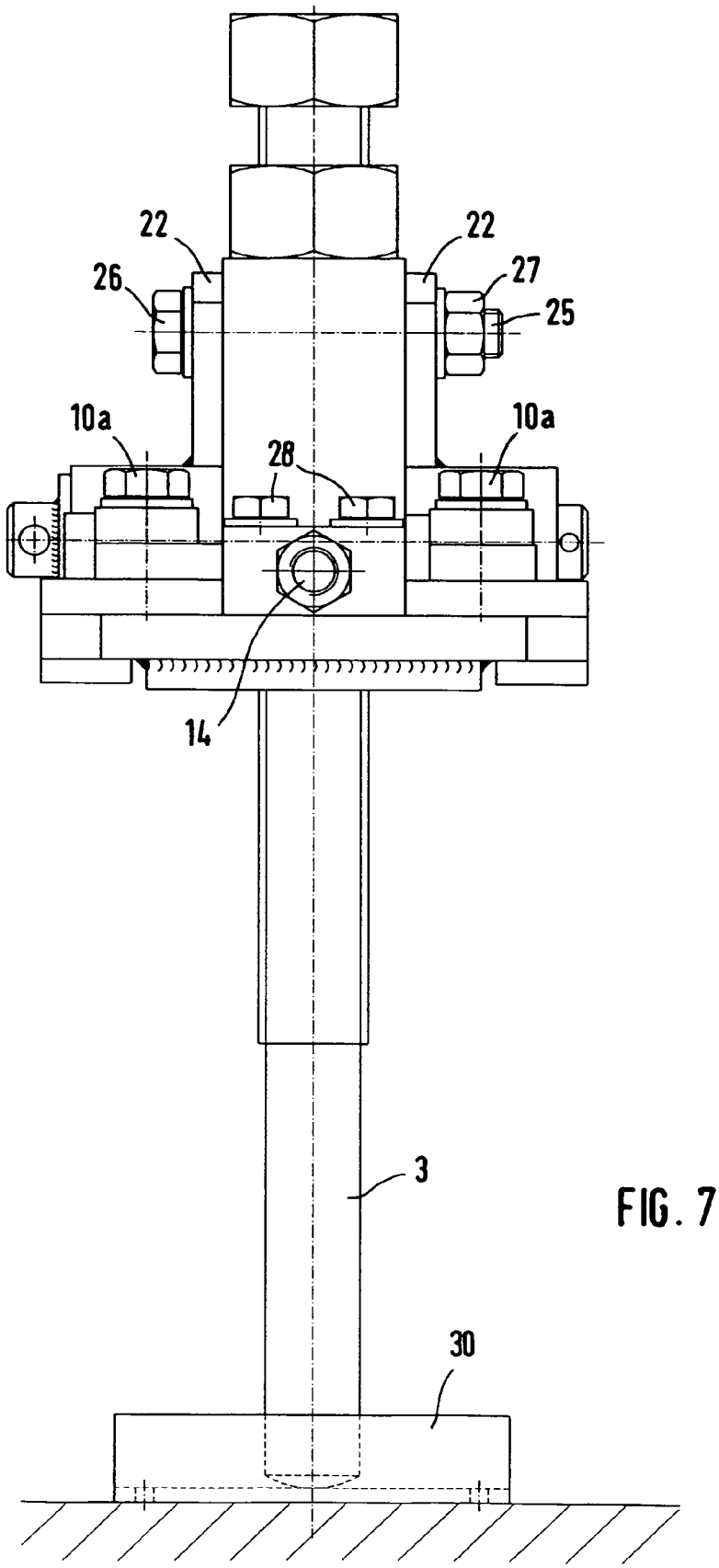
Figure 8:
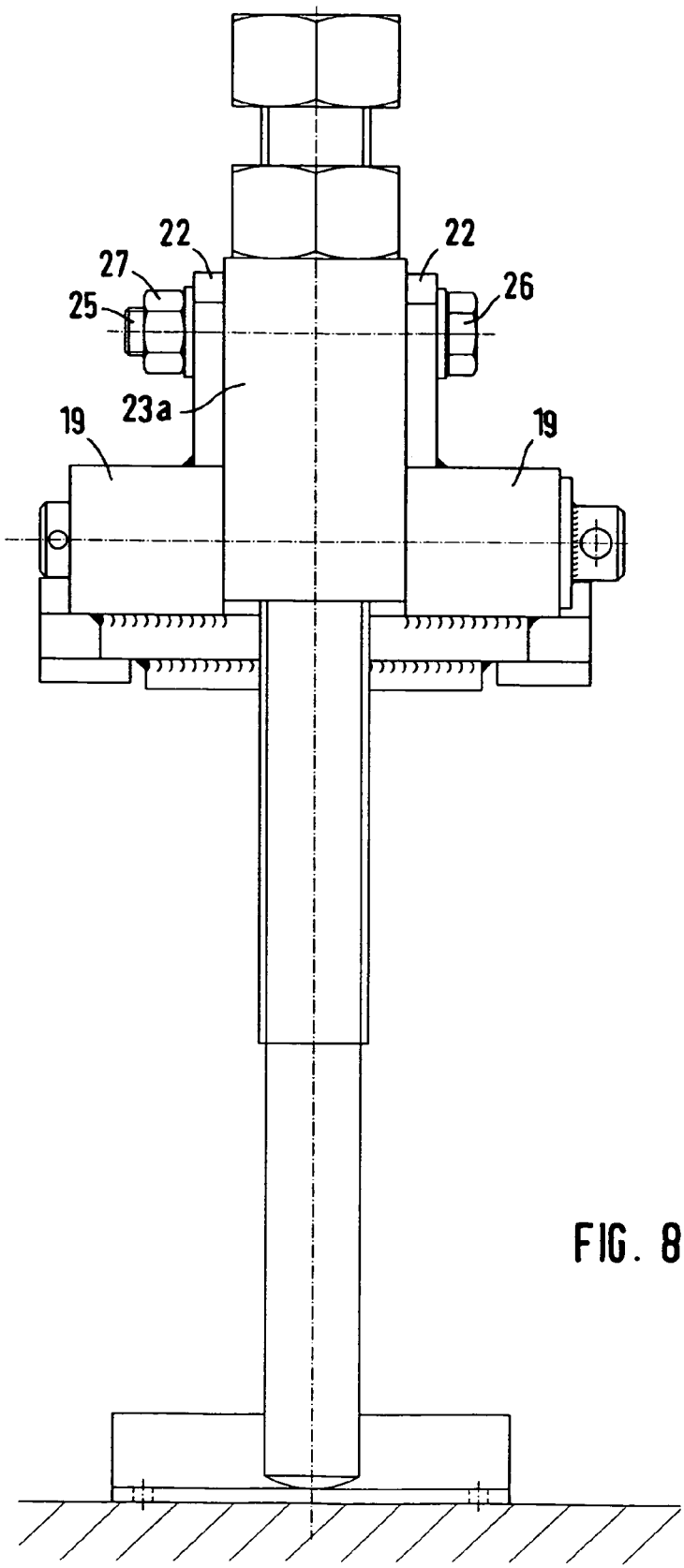
FIG. 8 a view from outside in the direction of the arrow VIII in FIG. 5.

The guide rails 18 encompassing the horizontal spindle plate 7 are fixed laterally on the ribbed plate 8, as can be seen in particular from FIG. 4, the guide rails in the example shown consisting of two parts screwed together. These form the slide guide proper.

The horizontal spindle plate 7 is welded to two sleeves 19, which are mounted on a pivot bearing bolt 20 of the pivot joint 6. Between these sleeves is a further sleeve 21, which is welded to the elongate nut 4 on the spindle 3. To these sleeves 19 and 21, plates are welded, which are provided with slots 24, so that a certain degree of pivoting can take place, as is necessary for the purpose of pivoting of the horizontal spindle plate at banked portions of the track grid. The threaded spindle 25 with its head 26 and a nut 27 permits clamped locking of the plates 22 and 23 relative to one another, so that the pivot joint 6 is locked. This locking of the pivot joint after alignment has taken place has the critical advantage that when a track grid is subjected to lateral forces, it cannot fall over. For such locking, obviously a quick tightener could alternatively be used.

FIGS. 5 to 8 show a second embodiment of a spindle device according to the invention which differs from that in FIGS. 1 to 4 in essentially two points. On the one hand, the hook 10 of the ribbed plate 8 is replaced with a screw 10*a*, which presses a clamping plate 10*b* on to the rail foot 12. This permits removal of the hook formed by these two parts 10*a* and 10*b*, in which case a lower supplementary plate 10*c* may be provided, which must be slightly lower than the height of the rail foot 12, so that after embedding of the aligned track grid with concrete, the ribbed plate 8 with the remaining parts of the spindle device can be easily removed to the left, without the need for previous lowering by the projection height of the hook 8, as in the embodiments according to FIGS. 1 to 4. According to this removability of the hook 10*a*, 10*b*, 10*c*, the second spindle device with the horizontal spindle 14 is to be fixed both detachably to the slide with the ribbed plate 8 and by means of the screw 28 detachably to the horizontal spindle plate 7.

Furthermore, instead of the spaced plates 23 with intermediate sleeves and support members, a solid block part 23*a* is provided, which is mounted pivotably and fixably between the cheeks 22 by means of the threaded spindle 25 with its head 26 and the nut 27.

At 30, an angled rail can be seen, whose horizontal flange 31 is fixed to the track substructure, whilst the upward-projecting flange 32 forms an abutment for the height adjustment spindle 3. To the left and right of the track grid, these angled rails are disposed in reverse, so that the upward-projecting flange respectively abuts the inner face of the height adjustment spindle 3. The upward-projecting flange thus prevents displacement of the support device in the horizontal direction to the left or right, whilst the horizontal flange forms a support rail for the bulky lower end of the height adjustment spindle 3, so that this can slide better in the axial direction of the track if relatively high temperature differences and corresponding lengthening of the track necessitate such displacement during the support period. This avoids complex longitudinal adjustment devices on the individual spindle devices, such as have been provided hitherto in the prior art.

As previously noted herein, it is deemed particularly advantageous if the support rails 30 are angled rails oriented opposite to one another with projecting bearing flanges 32 (upward projecting flange) for the height adjustment spindles 3, which prevents slipping off in the transverse direction, as depicted, for example, in FIG. 9. Also, as mentioned, U-shaped rails 30' having a pair of upward projecting flanges 32' could also be used, as shown, for example, in FIG. 10.

Alternatively, the rails may have U-shaped profiles.

The invention claimed is:

1. A spindle device for height adjustment and alignment of tracks on a substructure, comprising:

a height adjustment spindle;

an elongate nut being adjustable in height on said height adjustment spindle;

a transverse cantilever which is fixed to said elongate nut, said transverse cantilever being engageable under a rail, said transverse cantilever being formed as a horizontal spindle plate, said horizontal plate being mounted on the elongate nut and pivotable about a horizontal axis;

a second spindle device transverse to the height adjustment spindle; and a slide provided with a clamping mount device for a rail foot, said slide being fixed to said second spindle device, said slide being displaceable on said transverse cantilever by longitudinal adjustment of said second spindle device.

2. A spindle device according to claim 1, wherein the slide comprises a ribbed plate provided with guide rails encompassing the horizontal spindle plate with a clamping hook and a rail foot screw clamp.

3. A spindle device according to claim 1, wherein a rigid horizontal spindle penetrating a rest on the horizontal spindle plate is fixed to the slide and is displaceable by means of adjusting nuts abutting the rest on both sides along its longitudinal axis.

4. A spindle device according to claim 2, wherein the clamping hook is removable above the ribbed plate.

5. A spindle device according to claim 4, wherein the clamping hook is formed by a screw for a clamping plate overlapping the rail foot.

6. A spindle device according to claim 4, wherein the second spindle device is detachably fixed both to the slide and to the horizontal spindle plate.

7. A spindle device according to claim 1, wherein the horizontal spindle plate includes a fixable horizontal pivot joint.

8. A spindle device according to claim 1, wherein the elongate nut substantially overlaps the height adjustment spindle in order to increase its rigidity.

9. A spindle device according to claim 1, further including support rails, each of said support rails for the height adjustment spindle, said support rails being fixed so as to rest on the track substructure.

10. A spindle device according to claim 9, wherein the support rails are angle rails oriented opposite to one another having projecting abutment flanges for the height adjustment spindles or are U-shaped profiles.

11. A spindle device according to claim 1, wherein a standing angle is infinitely variable.

* * * * *